US005420466A

United States Patent [19]

Powers

[11] Patent Number: 5,420,466

[45] Date of Patent: May 30, 1995

[54] AUTOMATIC FREEZE PROTECTOR

[76] Inventor: Kevin K. Powers, 5589 Sycamore St., Wilmington, N.C. 28403

[21] Appl. No.: 36,214

[22] Filed: Mar. 19, 1993

[51] Int. Cl.[6] ..... H05B 1/02

[52] U.S. Cl. ..... 307/117; 219/491; 392/407

[58] Field of Search ..... 307/116, 117; 392/407; 315/309; 219/491, 494

[56] References Cited

U.S. PATENT DOCUMENTS

| | | | |
|---|---|---|---|
| 2,667,553 | 1/1954 | Moorhead et al. | 338/365 |
| 3,227,065 | 1/1966 | Litman | 392/407 |
| 3,739,150 | 6/1973 | Rahn | 392/407 |
| 4,236,084 | 11/1980 | Gingras | 307/117 |
| 4,314,223 | 2/1982 | Kristofek | 337/381 |
| 4,570,145 | 2/1986 | Carey | 337/3 |
| 4,694,223 | 9/1987 | Campolo | 315/318 |
| 5,177,658 | 1/1993 | Brenner et al. | 315/309 |

FOREIGN PATENT DOCUMENTS

| | | |
|---|---|---|
| 2101165 | 6/1940 | Switzerland . |
| 533923 | 2/1941 | United Kingdom . |

*Primary Examiner*—Jeffrey A. Gaffin
*Assistant Examiner*—Peter Ganjoo
*Attorney, Agent, or Firm*—Richard C. Litman

[57] ABSTRACT

A unitary device requiring no assembly by a user is plugged into an electrical power source to provide freeze protection. The device includes a socket for holding a heat lamp and a pressure connector, such as a plug, for connecting to an electrical receptacle or a live lamp socket. A remote sensor monitors temperature at a location remote from the device, and causes a switch to energize the heat lamp when freezing temperature is sensed. The device is supported by the plug or other connection to the power source. A commercially available heating lamp is a preferred heating element. Ease of installation and lamp replacement make the novel device highly practical for homeowner use.

10 Claims, 3 Drawing Sheets

AUTOMATIC FREEZE PROTECTOR

BACKGROUND OF THE INVENTION

1. Field of the Invention

The present invention relates to a unitary assembly ready for installing into an electrical source, the assembly including a radiant heater and a remote thermally responsive controller.

2. Description of the Prior Art

Thermally responsive controls and associated electrical heaters are known. U.S. Pat. Nos. 4,314,223, 4,694,223, and 5,177,658, issued respectively to Paul J. Kristofek on Feb. 2, 1982, to Steve Campolo on Sep. 15, 1987 and to Stanley S. Brenner et al. on Jan. 5, 1993, thermal protectors detecting dangerously high temperatures in lighting fixtures are described. Each respective protector acts automatically to interrupt current if a predetermined high temperature is reached in the fixture.

U.S. Pat. No. 4,570,145, issued to John C. Carey on Feb. 11, 1986, and U.K. Pat. Document No. 533,923, accepted Feb. 24, 1941 from the Simplex Electric Company and Percy W. Davis disclose an electrical receptacle or the like which interrupts current available to an appliance plugged into the receptacle when a predetermined temperature is reached.

In the above cases, the circuit interrupter reacts to a high temperature reached in or near the respective device.

U.S. Pat. No. 2,667,553, issued to John O. Moorhead et al. on Jan. 26, 1954, discloses a thermostatic switch having insulated lead-in conductors enabling the switch to be located remotely from an electrical device being controlled thereby. This invention provides only a control function, and does not include a heater.

Swiss Pat. Document No. 210,165 discloses an electrically operated thermostat which is supported when plugged into an electrical receptacle. This invention does not interrupt a power circuit to a heater, does not include a heater, and is not capable of detecting temperature at a remote point.

None of the above inventions and patents, taken either singly or in combination, is seen to describe the instant invention as claimed.

SUMMARY OF THE INVENTION

Many residences and other buildings have unheated portions wherein water conducting piping is exposed and is subject to damage from freezing. Examples of this include crawl spaces, unheated basements, beneath mobile homes, and associated but detached structures, such as pumphouses. It is desirable to provide uncomplicated, inexpensive, and efficient heating of the exposed piping and associated equipment.

Most such unheated areas have electrical power readily available from receptacles, lamp sockets, and the like. The present invention provides a self-contained apparatus to detect a freezing condition, and to heat the unheated area automatically in response to low temperature. The novel automatic freeze protector includes a housing which attaches to and makes electrical connection with the power source, a remote thermostatic control, and a radiant heater.

In order to maximize practicality, the automatic freeze protector is small and compact, and is supported on the apparatus providing electrical power, so that the electrical and mechanical supporting connection are provided by the same structure. The freeze protector employs readily available radiant heating elements, so that the element is readily replaced if defective and for resizing, to change the amount of heat produced thereby. To be maximally appealing to homeowners, who generally cannot be counted upon to be knowledgeable with respect to electrical appliances, the device is unitary, such that neither assembly nor electrical connections need be made apart from installing the device in a common electrical receptacle or socket. The only knowledge demanded of the user is the ability to install a light bulb in its associated socket, and to be able to plug an electrical supply cord into an associated electrical receptacle.

The specialized nature of the task of the automatic freeze protector require that it be responsive to ambient freezing temperature, and not be influenced by its own temperature.

To these ends, the automatic freeze protector comprises a housing including a plug or similar connection device, a socket for accepting an ordinary light bulb or lamp, a remote controller, and a lamp producing radiant heat. The remote controller includes a preattached, insulated conductor connected to a switch operated by a thermally responsive sensor. The conductor enables locating the sensor sufficiently distant from the lamp that the switch responds to ambient temperature, and the sensor is removed from heat produced by the radiant heater. Also, on-and-off cycling of the heater is precluded, and the heater will operate only if there is actual need for heat.

A preferred radiant heater is provided by mass produced, commercially available infrared lamps, which need only be threaded or similarly installed in its associated socket. Such lamps are available in varieties offering different outputs, operable on different electrical voltages, and offering a variety of base configurations for installation in different types of sockets.

An advantage of a heat lamp is that the heating element also produces light, enabling work in otherwise dark areas, and provides an indication of system operation.

Accordingly, it is a principal object of the invention to provide an automatic, thermally responsive electrical heater.

A second important object is to provide an automatic heater which readily and detachably connects to and disconnects from household electrical power.

Still another important object of the invention is to provide an automatic heater which is supported by the same structure making electrical connection to household electrical power.

It is another important object of the invention is to provide an automatic heater accepting a conventional, commercially available removable heating lamp.

Still another important object of the invention is to provide an automatic heater having a remote, thermally responsive controller.

It is a further object of the invention to provide an automatic heater which is unitary in its construction, requiring neither assembly nor connection requiring tools.

An additional object of the present invention is to provide an automatic heater which operates in response to ambient temperature and which is not influenced by its own heat output.

A still additional object of the invention is to provide an automatic heater which avoids on-and-off cycling.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
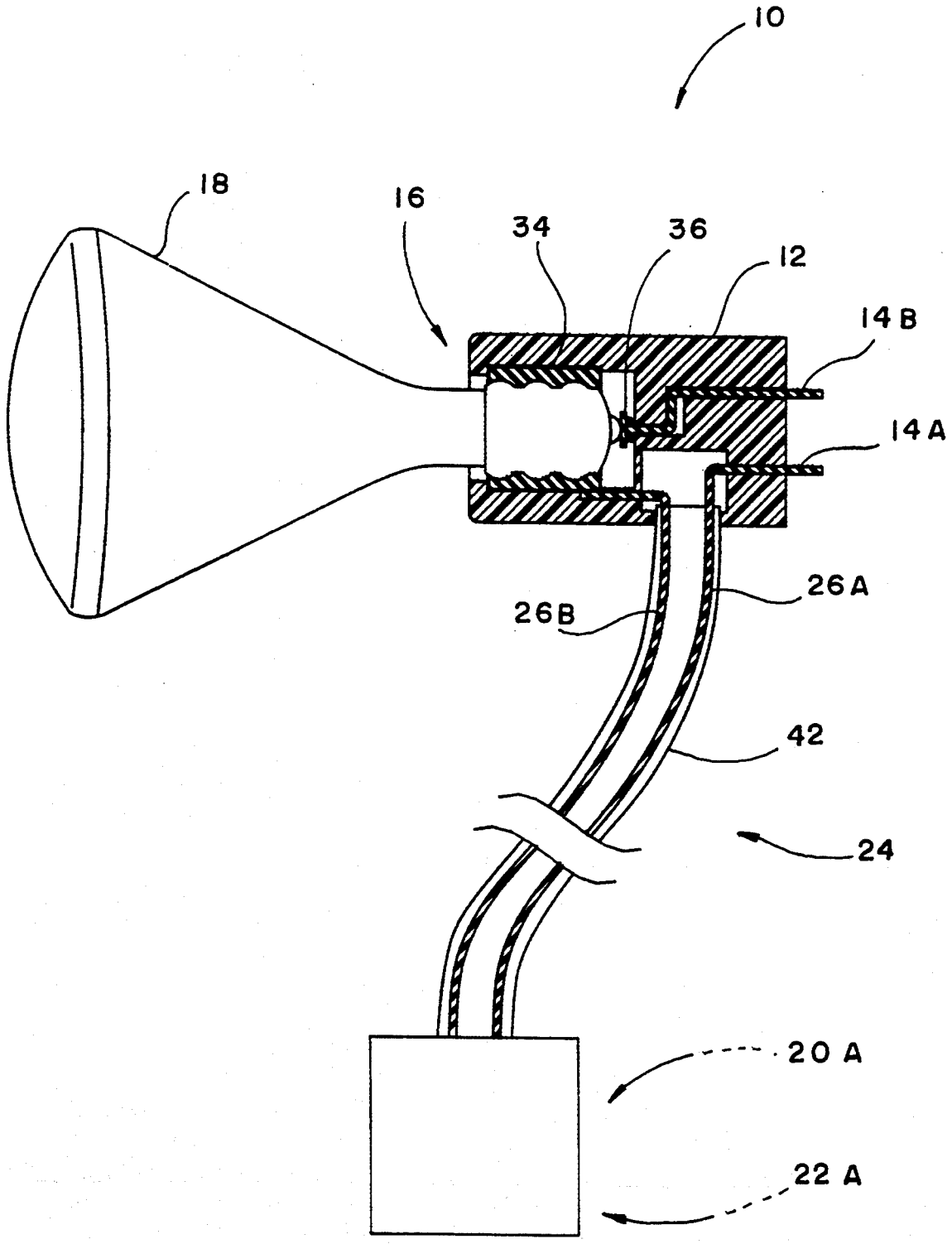
FIG. 1 is a side elevational, cross sectional view of the invention.

The automatic freeze protector 10 of the present invention is seen in FIG. 1 to comprise a housing 12 supporting plug prongs, 14A, 14B and a lamp socket 16 for holding and completing an electrical circuit to a lamp 18. Lamp 18, preferably a commercially available heat lamp which produces both light and heat, is threaded into lamp socket 16. A remote temperature sensor 20A and switch 22A, which may be of the type disclosed in Moorhead et al. '553 or of other well known remote sensor and switch having conductors for remote connection, are connected to housing 12 by a flexible cable 24 having two electrical conductors 26A, 26B. Sensor 20A and switch 22A are thus able to be positioned distant from lamp 18. Cable 24 is preferably four to six feet (120 to 180 cm) long, so that sensor 20A and switch 22A can be placed behind an object (not shown), such as a pipe, storage tank, or pump, being protected, where ambient temperature could be below the freezing point, in this manner, freezing temperature is successfully detected. If the sensor 20A were to be close to lamp 18, it would be possible that sensor 20A would be exposed to sufficient heat to cause the circuit to remain open, despite sub-freezing temperature at the protected object. In such a case, in the absence of a remote sensor, this object could freeze.

Figure 2:
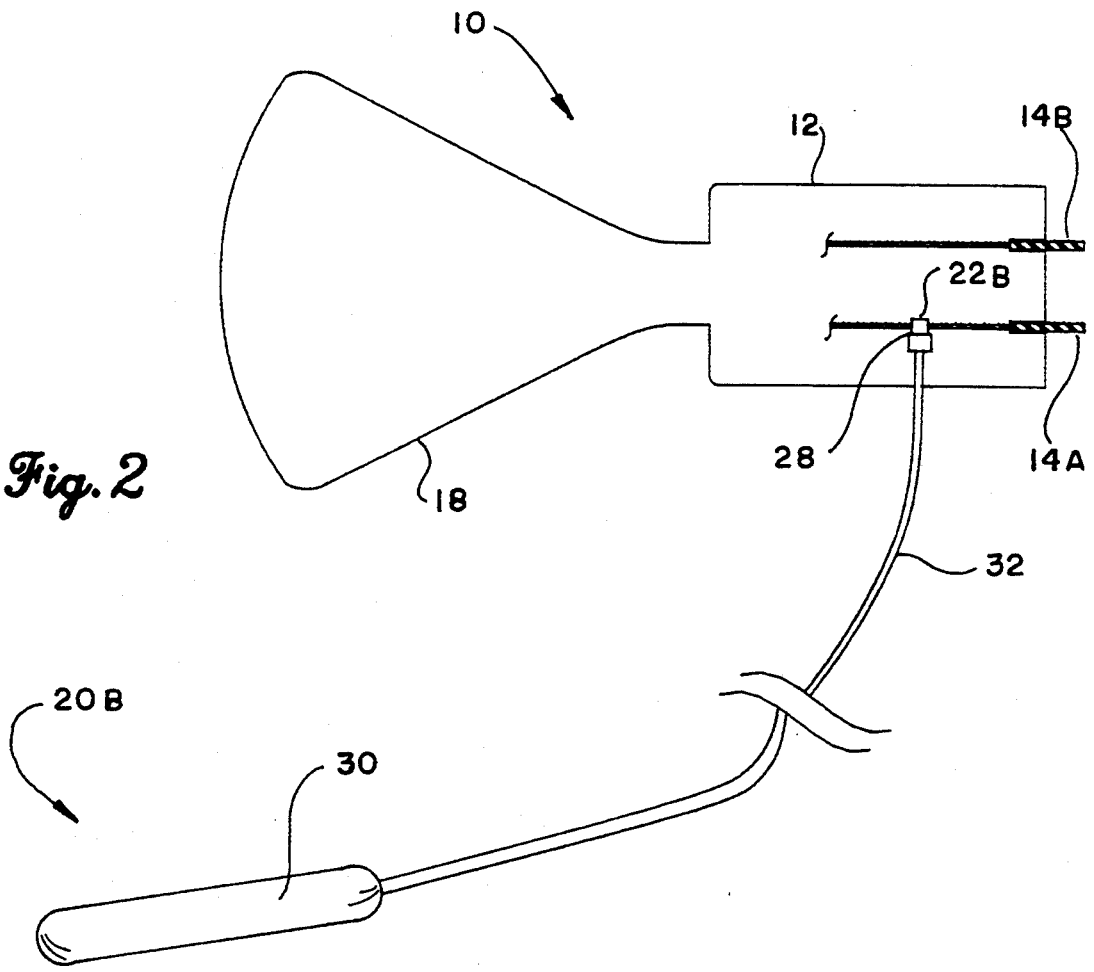
FIG. 2 is a side elevational, partially cross-sectional view of an alternative embodiment of the invention, with some details omitted for clarity.

Alternatively, only a sensor 20B is remote, as seen in FIG. 2. A thermostat 28 of well known type having a remote bulb 30 and a connecting capillary 32 enables bulb 30 to be remote, switch 22B being located within housing 12. In this context, "switch" is understood to encompass components responsive to fluid pressure from bulb 30, and employs fluid pressure to move switch contacts (not shown) so as to open and close an electrical circuit.

The automatic freeze protector 10 is connected to household electrical power by any ordinary electrical connection. Ordinary electrical connection will be understood to mean standard apparatus customarily provided for temporary, manual connection of electrical conductors to electrical terminals and secured by frictional fit. Examples of ordinary electrical connections include the prongs of a multiprong plug and cooperating receptacle, a screw base and cooperating socket, a bayonet base and cooperating socket, and other generally known, generally available male and female type connectors. The female members of ordinary electrical connection arrangements will be referred to as ordinary electrical connection receptacles. Conductors 26A, 26B are joined to, respectively, plug prong 14A and to circumferential electrode 34 of lamp socket 16 (see FIG. 1).

Of course, switch 22A or 22B could be arranged to break one leg or line of the electrical circuit connected to center electrode 36. It would further be possible to provide a four conductor cable and a switch 22A or 22B breaking both legs or lines, if desired. These variations would achieve the same effect in controlling freeze protector 10, and it will therefore be understood that breaking a line or leg comprises interruption of any portion of a circuit connected to first and second incoming power lines 38,40 (see FIG. 3) between which a utilization voltage potential exists.

Again referring to FIG. 1, cable jacket 42 is preferably tightly held within housing 12, and connection between cable conductors 26A, 26B and their associated plug prong 14A and lamp socket electrode 34 is preformed and concealed within housing 12, so that a user need not assemble freeze protector 10. It is possible to provide removable fasteners, such as screws (not shown), to secure conductors 26A, 26B to plug prong 14A and electrode 34. If this arrangement were selected, the threaded connection should be located within housing 12, both to insulate conductive metal parts, and to enable the threaded connection to be preformed during manufacture, and concealed from a user.

Housing 12, lamp 18, lamp socket 16, and prongs 14A,14B are sufficiently light that they are supported by mechanical engagement of prongs 14A, 14B with a standard electrical receptacle (not shown).

Figure 3:
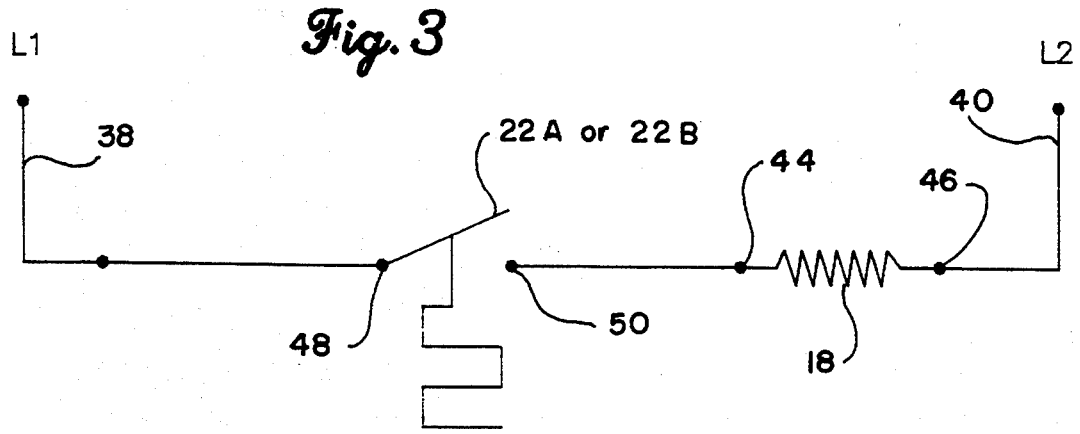
FIG. 3 is an electrical schematic diagram of the invention.

FIG. 3 shows an electric schematic of the preferred embodiment. In keeping with the unitary, preformed nature of the invention 10, electrical junctions 44, 46 are protected and concealed within housing 12 (refer to FIG. 1). In the alternative embodiment wherein a bulb type thermostat 28 is employed, electrical junctions 48, 50 are also contained within housing 12.

Figure 4:
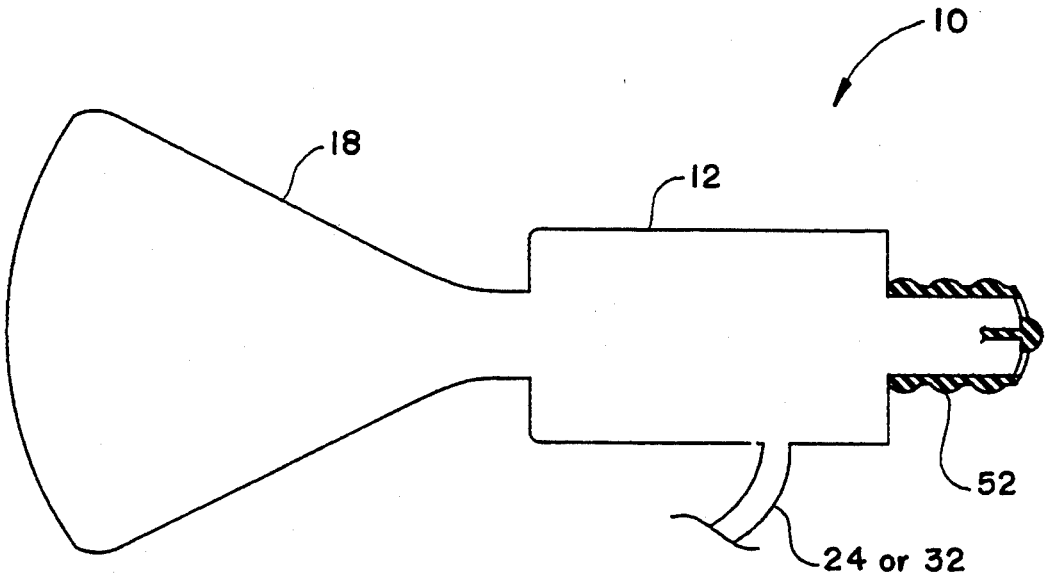
FIGS. 4 and 5 are side elevational, partially cross-sectional views of alternative embodiments of the invention, with some omitted for clarity.
Figure 5:
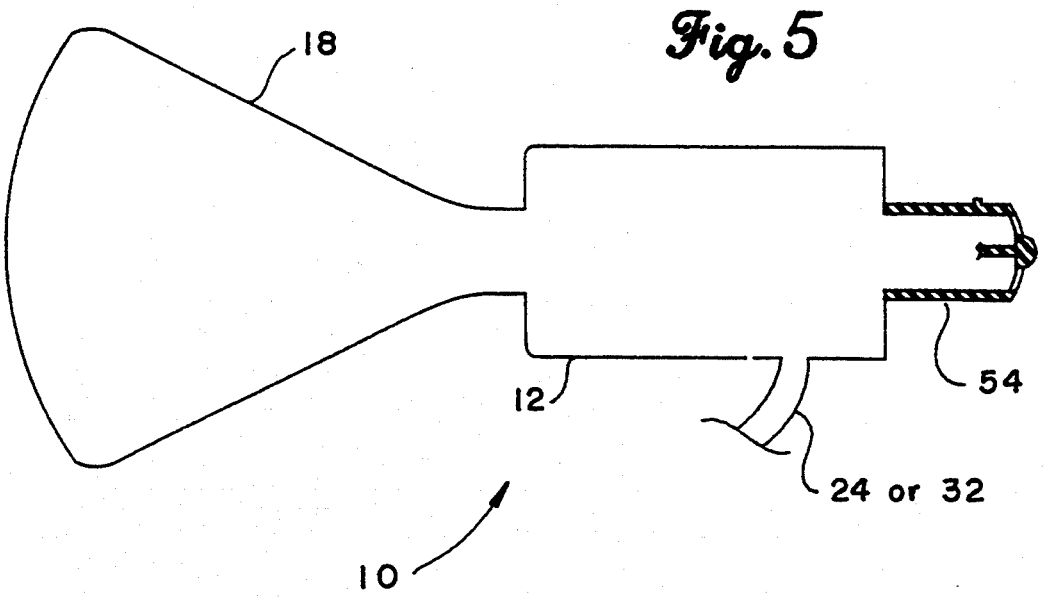

Plug prongs 14A, 14B of the preferred embodiment of FIG. 1 are replaced, in additional embodiments, by a screw base 52 (FIG. 4) and by a bayonet base 54 (FIG. 5). These embodiments enable attachment of automatic freeze protector 10 to an idle lamp socket (not shown) in the building (not shown). This may be necessary in those cases wherein lighting fixtures are available to provide ready connection to electrical power in the absence of a standard electrical receptacle.

It is to be understood that the present invention is not limited to the embodiments described above, but encompasses any and all embodiments within the scope of the following claims.

I claim:

1. An automatic freeze protector comprising:

a housing containing an electrical connection means for attaching to an electrical connection receptacle;

a lamp socket electrically connectable by switch means to said electrical connection means, and supported thereby, heating means mounted in said lamp socket means;

a switch means for making and breaking electrical continuity in at least one conductor provided between said electrical connection means and said lamp socket;

remote sensor means for sensing ambient temperature and providing an input to said switch means, said remote sensor means being located remote from said housing a predetermined distance therefrom, whereby said sensor senses ambient temperature and avoids responding to heat from said heating means, thus avoiding interrupting power prematurely and avoiding on-and-off cycling;

flexible connection means for connecting said remote sensor means to said housing; and said remote sensor means and said switch means are located remote from said housing, and said flexible connection means comprise electrically insulated conductor means for providing electrical continuity selected from: (1) at least one leg of a line and a line extending between said electrical connection means and said switch means, and (2) at least one leg of a line and a line extending between said switch means and said lamp socket means.

2. The automatic freeze protector according to claim 1, said heating means comprising a heat lamp threaded into said lamp socket, whereby said automatic freeze protector, when heating, produces heat to protect objects from freezing, and light to enable activity in a space protected by said automatic freeze protector and to signal operation of said automatic freeze protector.

3. The automatic freeze protector according to claim 2, wherein said electrical connection means comprises a plug.

4. The automatic freeze protector according to claim 2, wherein said electrical connection means comprises a screw base.

5. The automatic freeze protector according to claim 2, wherein said electrical connection means comprises a bayonet base.

6. An automatic freeze protector comprising:

a housing containing an electrical connection means for attaching to an electrical connection receptacle;

a lamp socket electrically connectable by switch means to said electrical connection means, and supported thereby, heating means mounted in said lamp socket;

a switch means for making and breaking electrical continuity in at least one conductor provided between said electrical connection means and said lamp socket;

remote sensor means for sensing ambient temperature and providing an input to said switch means, said remote sensor means being located remote from said housing a predetermined distance therefrom, whereby said sensor senses ambient temperature and avoids responding to heat from said heating means, thus avoiding interrupting power prematurely and avoiding on-and-off cycling;

said remote sensor means comprising a bulb and a flexible connection means comprising a capillary for connecting said bulb to said housing, and wherein said switch means is contained within said housing.

7. The automatic freeze protector according to claim 6, said heating means comprising a heat lamp threaded into said lamp socket, whereby said automatic freeze protector, when heating, produces heat to protect objects from freezing, and light to enable activity in a space protected by said automatic freeze protector and to signal operation of said automatic freeze protector.

8. The automatic freeze protector according to claim 7, wherein said electrical connection means comprises a plug.

9. The automatic freeze protector according to claim 7, wherein said electrical connection means comprises a screw base.

10. The automatic freeze protector according to claim 7, wherein said electrical connection means comprises a bayonet base.

* * * * *